US005441155A

United States Patent [19]

Eldar

[11] Patent Number: 5,441,155

[45] Date of Patent: Aug. 15, 1995

[54] METHOD FOR PROCESSING DOMESTIC GARBAGE

[76] Inventor: Dor Eldar, 18 Ugarit Street, Tel Aviv, Israel

[21] Appl. No.: 206,876

[22] Filed: Mar. 7, 1994

[30] Foreign Application Priority Data

Mar. 7, 1993 [IL] Israel ..... 104968

[51] Int. Cl.[6] ..... B07C 7/04

[52] U.S. Cl. ..... 209/10; 209/702; 209/930

[58] Field of Search ..... 209/702, 930, 942, 10; 383/38, 39, 40, 208; 220/23.4, 23, 83, 909

[56] References Cited

U.S. PATENT DOCUMENTS 4,750,639 6/1988 Schaerer ..... 383/38 X
4,893,719 1/1990 Lombardi et al. ..... 220/23.4
4,949,528 8/1990 Palik ..... 209/930 X
4,974,746 12/1990 Dickinson ..... 209/930 X
5,018,876 5/1991 Mennella ..... 220/909 X
5,167,342 12/1992 Merritt ..... 383/38 X
5,246,119 9/1993 Heffner ..... 220/909 X

*Primary Examiner*—D. Glenn Dayoan
*Attorney, Agent, or Firm*—Ostrolenk, Faber, Gerb & Soffen

[57] ABSTRACT

A method for processing domestic garbage includes the steps of sorting the garbage into two or more classes and placing each class into a unified domestic container. The container is divided into a respective number of compartments. The containers are transferred to a garbage dump site and dismembered into their compartments. Then, each compartment is transferred to its respective garbage class treatment location.

10 Claims, 2 Drawing Sheets

METHOD FOR PROCESSING DOMESTIC GARBAGE

FIELD OF THE INVENTION

The present invention relates to the field of domestic garbage collecting and processing.

BACKGROUND OF THE INVENTION

Ecological as well as energy and natural resources preservation considerations play a more and more intensive roll in the direction of altering the traditional processing methods relating to the collection and discarding of domestic garbage. One of the main developments has been expressed by State or Municipal Regulations, directed to enforce a change in the collection habits of the public. In general, directives has been issued in more and more countries to compel the individual households to perform a selection or sorting of the garbage into two or more classes, each requesting a separate type of treatment. The sorting of the garbage at its source enabled a subsequently different treatment of every class in a more economic manner with regard to the processing thereof, be it complete discarding (burning, burying), recycling or reusing. Sorting at the source became a milestone in the struggle of mankind towards less pollution and waste of precious energy.

At present, the pre-sorting of garbage is effected in a most primitive fashion, namely that the household owner puts one class into a first container, another class into a second container, etc.; the containers are usually plastic bags, which are then carried down to the building collecting location and put into separate receptacles, from which they are emptied into the garbage trucks, during their usual rounds on their way to the dump site. The containers of the different classes are distinctly marked, to facilitate their subsequent separation and different methods of treatment.

A further development or refinement of this approach has been introduced concerning a garbage collecting timetable imposed by the municipal authorities, limiting the collection to once or twice a week, compelling the citizens to conform by allowing the garbage to be taken out only at the night, preceding the prescribed collection day.

This compulsive garbage handling routine imposes a considerable amount of inconvenience on the public at large. It is therefore the prime object of the present invention to improve the pre-sorting operation of garbage in making it more convenient—and thereby more likely to be adhered to by the public—and more economic regarding the handling at the garbage dump sites.

It is a further object of the invention to provide an improved container for use in the proposed method.

It is a still further object of the invention to introduce minimum changes into the present, conventional routine of garbage collection, as well as at the garbage dump sites.

SUMMARY OF THE INVENTION

The invention thus provides for a method of processing domestic garbage comprising the steps of sorting the garbage into two or more classes and placing each class into a unified domestic garbage container. The container is divided into a respective number of compartments. The containers are collected and transferred to a garbage dump site and dismembered into their compartments. Each compartment is transferred to its respective garbage class treatment location.

The container is preferably in form of a bag made of a pliable sheet material, such as plastics, with a series of pockets being integrally formed therewith.

BRIEF DESCRIPTION OF THE DRAWINGS

Further details, features and advantages of the invention will become more clearly understood in the light of the ensuing description of a preferred embodiment thereof, given by way of example only with reference to the accompanying drawings, wherein.

DETAILED DESCRIPTION OF THE PREFERRED EMBODIMENT

Figure 1:
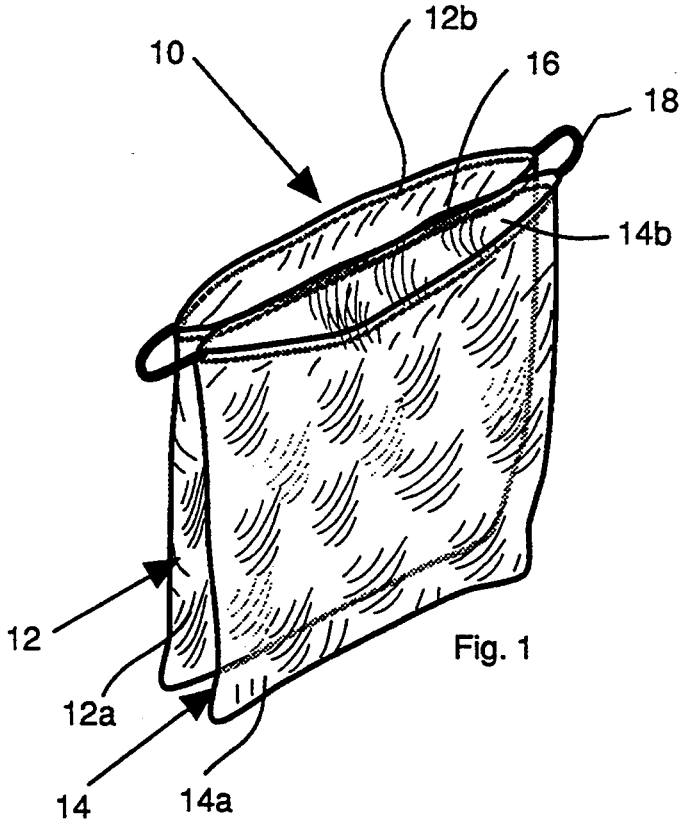
FIG. 1 is a perspective view of a bag containing two pockets useful for the method according to a preferred embodiment of the invention.
Figure 2:
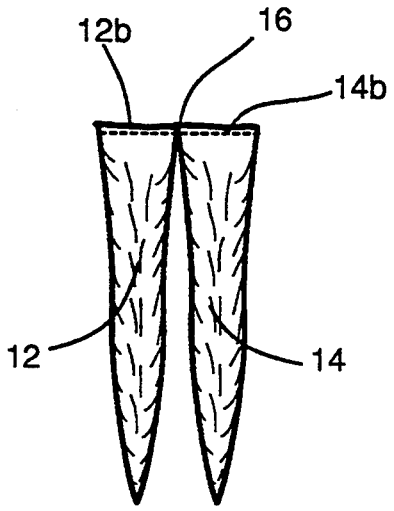
FIG. 2 is a side view of the bag of FIG. 1.

Referring to FIG. 1 there is shown a double-pocket bag denoted 10, generally comprising a pair of more-or-less conventional garbage bags 12 and 14, each having an envelop body portion 12*a* and 14*a* and an open mouth portion 12*b* and 14*b*. The pockets 12 and 14 may be made of plastic sheet material such as nylon or polyethelene. Most conveniently the two compartment or pocket-like bags are seamed together along the adjacent sides of their respective mouth portions 16 as more clearly seen in FIG. 2. However, any other suitable method of integrally forming the pockets 12 and 14 with each other may be used, provided free access is maintained for the charging thereof with the respective garbage classes.

Figure 4:
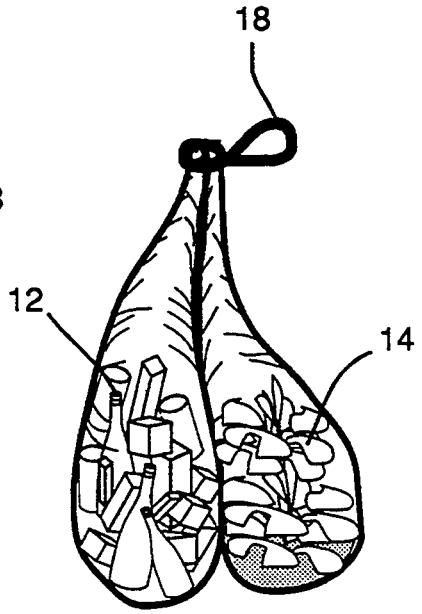
FIG. 4 shows the bag after being tied closed, i.e. ready for carrying and placing it in the garbage collecting location.

A tying strip 18 is provided in a form enabling the closing of bag 10 (see FIG. 4).

Figure 3:
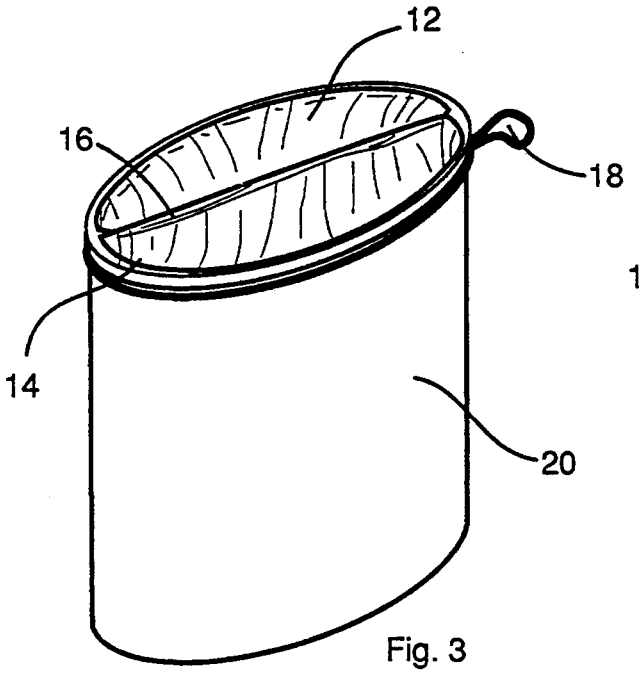
FIG. 3 illustrates a garbage container.

The bag 10 is readily placeable in a garbage bucket-like container 20 as illustrated in FIG. 3, which is preferably of an oval configuration.

For easy and unmistakable identification by the user, the pockets 12, 14 (or more—if provided) may differ from each other by color, texture, indicia marking and the like distinction means.

In the case of a double-pocket bag as so far illustrated, the garbage is pre-sorted into solid stuff such as cans, packages, or other metal or glass items which are to be placed in one of the pockets 12, and food remainders or other moist stuff which is placed in the other compartment 14. When appropriate, the bag as whole is taken out of its container 20, tied by its tying strip 18 as shown in FIG. 4, and taken down to the garbage collecting room of the residential building, or otherwise prepared for collection.

The procedure of collecting the garbage bags remains conventional, namely that garbage trucks are making the rounds as usual, collect the bags and transfer same to the garbage dump site.

Figure 5:
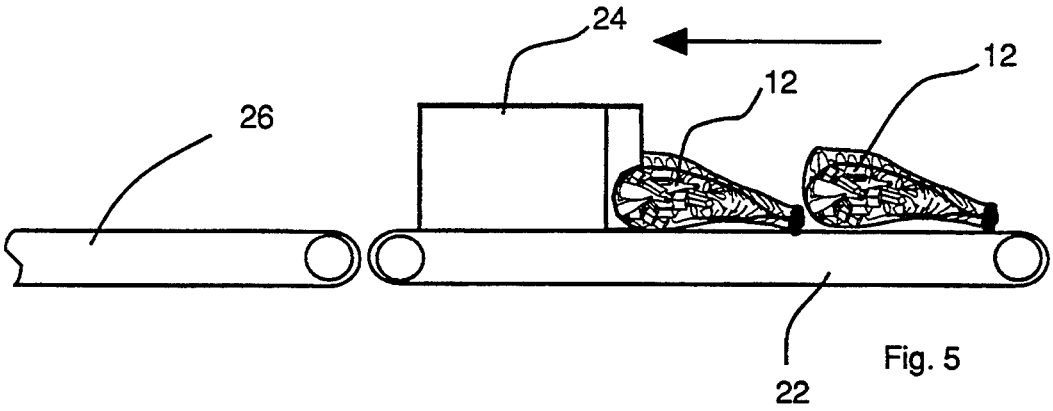
FIGS. 5 and 6 are respectively schematic side and top views of a conveyer installation applicable for the initial stage of processing the garbage bags at the dump site.
Figure 6:
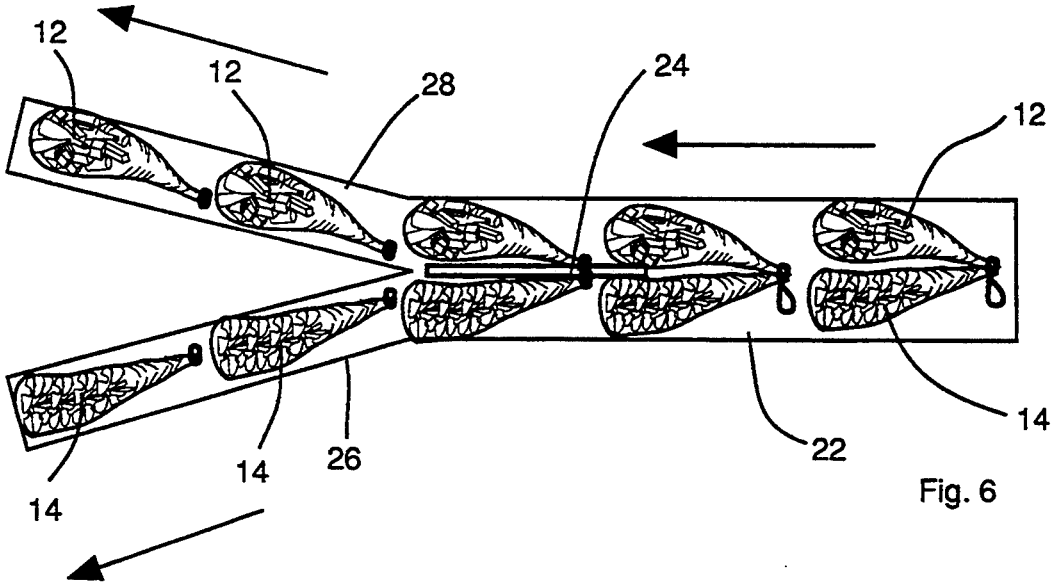

Now, according to another unique feature of the invention the garbage bags 10 are separated into their individual pockets, which process may be effected by the installation schematically illustrated in FIGS. 5 and 6. Hence, the bags are loaded on a conveyer-belt assembly 22 and carried thereon so that a slicing knife device denoted 24 (or Laser beam arrangement) becomes operative to slice or cut through the tied mouth portion of the bag to separate same into its individual pockets 12 and 14 as clearly shown in FIG. 6. From that on each class of pockets is conveyed to its suitable further processing station on respective conveyer devices 26, 28.

The outstanding advantages of the method are thus apparent, namely in that by the pre-sorting applied by the users without any investment, a significant economic saving is attained in the further processing of garbage for the benefit of the public at large.

Those skilled in the art will readily appreciate that numerous changes, variations and modifications may be applied to the invention as hereinbefore exemplified without departing from the scope of the invention as defined in and by the appended claims.

What is claimed is:

1. A method of processing domestic garbage comprising the steps of:

sorting the garbage into first and second classes, placing each class into a unified domestic garbage container comprising a respective number of compartments and located remote from a garbage dump site, thereafter collecting and transferring the container to said garbage dump site, thereafter dismembering the container into its compartments, and transferring each compartment so dismembered to its respective garbage class treatment location;

said container being in the form of a bag made of a pliable sheet material and having an envelope portion, an open mouth portion at a first end of said envelope portion and a closed portion at a second end of said envelope, said second end being opposite said first end;

said bag comprising a series of integrally formed pockets that are connected to each other at said open mouth portions by a seam that is generally parallel to said second end;

said bag being closable by a tying strip at said first end wherein said dismembering is effected by cutting the tied-together portion of the bag to thereby separate the bag into first and second pockets.

2. A method as claimed in claim 1 wherein the bag is made of plastics.

3. A method as claimed in claim 1 wherein the pockets are connected to each other solely in the vicinity of their open mouth portions.

4. A method as claimed in claim 1 wherein at said dump site the bags are loaded on movable conveying means with said first ends being downstream of said second ends, said bags being adapted to be sliced apart during movement thereof by utilizing a stationary cutting means, each separated pocket being transferred by separate conveying means to a different predetermined destination.

5. A method as claimed in claim 1 wherein each of said pockets is of a different color.

6. A method as claimed in claim 1 wherein the material of each of said pockets is of a different texture.

7. A method as claimed in claim 1 wherein prior to said dismembering there is relative movement between said bag and a stationary knife used to dismember said container such that said knife passes between said pockets from said second end to said first end.

8. A method as claimed in claim 3 wherein at said dump site the bags are loaded on movable conveying means with said first ends being downstream of said second ends, said bags being adapted to be sliced apart during movement thereof by utilizing a stationary cutting means, each separated pocket being transferred by separate conveying means to a different predetermined destination.

9. A method as claimed in claim 8 wherein prior to said dismembering there is relative movement between said bag and a stationary knife used to dismember said container such that said knife passes between said pockets from said second end to said first end.

10. A method of processing domestic garbage comprising steps of:

sorting the garbage into two or more classes, placing each class into a unified domestic garbage container comprising a respective number of compartments and is located remote from a garbage dump site, collecting and transferring the container to said garbage dump site, dismembering the container into its compartments, and transferring each compartment so dismembered to its respective garbage class treatment location;

said container being in the form of a bag constructed of a pliable plastic sheet material, and having an envelope portion, an open mouth portion;

said bag comprising a series of integrally formed pockets seamed to each other at their open mouth portions; said bag being closable by a tying strip;

said dismembering being effected by cutting the tied-together portion of the bag thereby separating the bag into its respective number of pockets; and said bags being loaded on movable conveying means, and being adapted to be sliced apart during movement of said bags by said conveying means, with stationary cutting means being utilized to slice said bags apart, and with each separated pocket being transferred by separate conveying means to a predetermined destination.

* * * * *